United States Patent [19]

Markus et al.

[11] Patent Number: 4,850,700

[45] Date of Patent: Jul. 25, 1989

[54] METHOD AND APPARATUS FOR PRODUCING A COAL/WATER MIXTURE FOR COMBUSTION IN A FLUIDIZED BED UNIT

[75] Inventors: Eugen Markus, Meinerzhagen; Hubert Steven, Gummersbach; Raimund Croonenbrock, Langerwehe, all of Fed. Rep. of Germany

[73] Assignee: L. & C. Steinmüller GmbH, Gummersbach, Fed. Rep. of Germany

[21] Appl. No.: 197,860

[22] Filed: May 24, 1988

[30] Foreign Application Priority Data

Jun. 3, 1987 [DE] Fed. Rep. of Germany ..... 3718568

[51] Int. Cl.[4] ..... B01F 15/02

[52] U.S. Cl. ..... 366/132; 366/134; 366/141; 366/153; 366/158; 366/168; 366/601

[58] Field of Search ..... 366/14, 15, 16–18, 366/40, 64, 76, 131, 132, 134, 141, 151–153, 154–156, 157, 167, 168, 173, 177, 182, 292, 297, 299, 601

[56] References Cited

U.S. PATENT DOCUMENTS

| | | | |
|---|---|---|---|
| 4,312,265 | 1/1982 | Enterline et al. | 366/158 X |
| 4,322,168 | 3/1982 | Hartung et al. | 366/15 |
| 4,403,863 | 9/1983 | Fukushima et al. | 366/15 |
| 4,407,431 | 10/1983 | Hutter, III | 366/137 X |
| 4,498,783 | 2/1985 | Rudolph | 366/132 |
| 4,606,648 | 8/1986 | Coyle et al. | 366/300 |
| 4,614,438 | 9/1986 | Kobayashi | 366/132 |
| 4,741,264 | 5/1988 | McPeak | 366/601 X |
| 4,759,632 | 7/1988 | Horiuchi et al. | 366/51 X |

*Primary Examiner*—Timothy F. Simone

*Attorney, Agent, or Firm*—Becker & Becker, Inc

[57] ABSTRACT

A method and apparatus for producing a coal/water mixture for combustion in a fluidized bed unit. To produce a hydraulically transportable coal/water mixture, crushed raw coal is preliminarily mixed with water in a first stage. This mixture is final mixed in a second mixing stage. The fine grain-size fraction required for the hydraulic transport is generated in the first mixing stage. The viscosity of the mixture present in the second mixing stage is determined, and as a function thereof additional water is added to the mixture in the second mixing stage, and/or the mixing process in the first mixing stage is altered in order to alter the fine grain-size fraction.

8 Claims, 1 Drawing Sheet

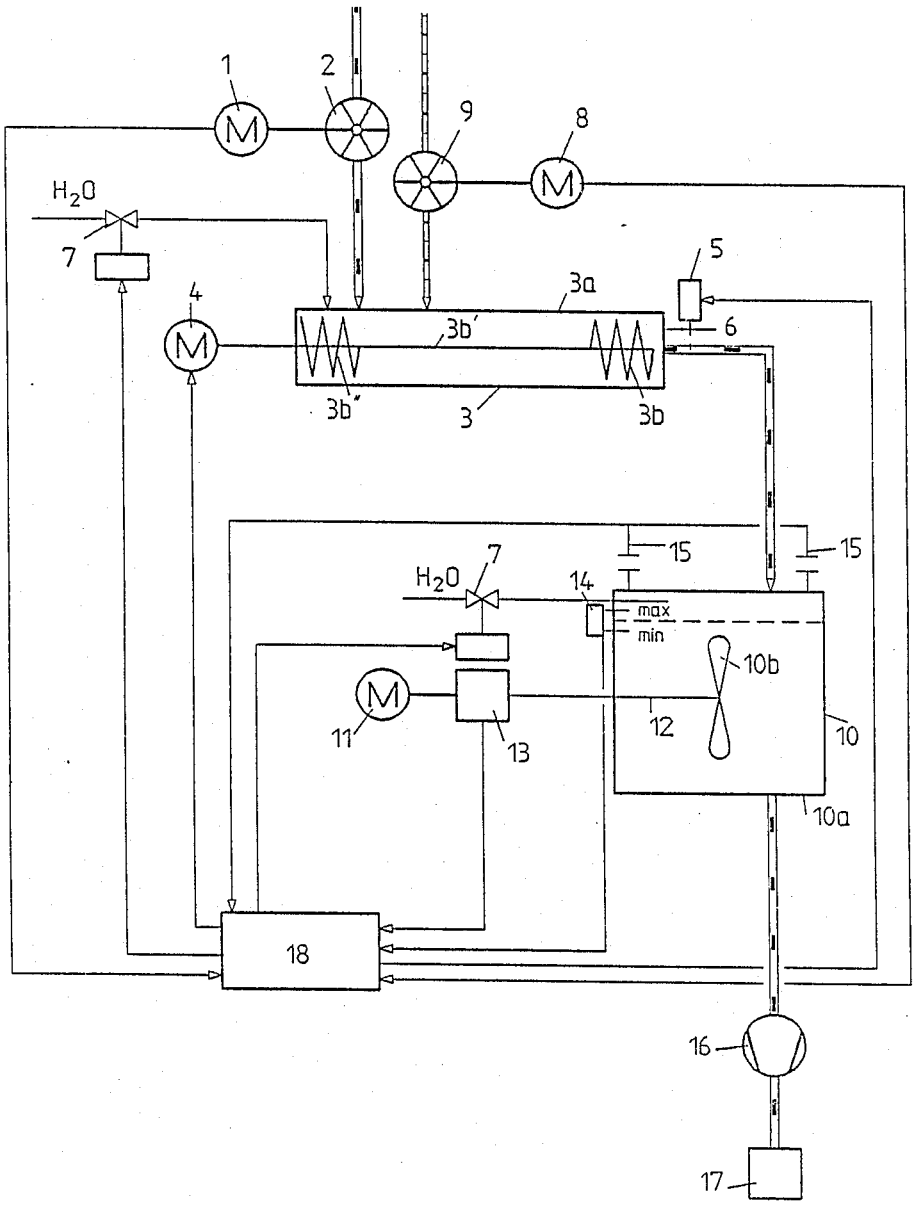
1
2
9
8
M
M
$H_2O$
7
5
4
3a
6
M
3b'
3b''
3
3b
15
15
7
$H_2O$
14
max
min
10b
M
11
13
12
10
10a
18
16
17

METHOD AND APPARATUS FOR PRODUCING A COAL/WATER MIXTURE FOR COMBUSTION IN A FLUIDIZED BED UNIT

BACKGROUND OF THE INVENTION

The present invention relates to a method and apparatus for producing a coal/water mixture for combustion in a fluidized bed combustion unit, especially in a pressurized fluidized bed unit.

The prospectus "Das Heizkraftwerk der RWTH Aachen", January 1987, especially the inside of the cover page, FIG. 1*a*, and page 13, FIG. 1*b*, discloses a method of this type, where coal, accompanied by the addition of water and lime as a sulfur-binding agent, is preliminarily mixed and is final mixed in a mixer. The thus-produced mixture is supplied via a dense or heavy material pump to a fluidized bed combustion unit. The planned-for coal, with a grain-size fraction of 22% by weight <1 mm (as addressed on page 4), could not always be delivered.

In the supply state, the coal is a crushed crude or raw coal. During the preliminary and final mixing, a fine grain-size fraction is rubbed off from the crushed raw coal. The hydraulic transportability of coal/water suspensions is known, in particular with combustion units that are fired with burners. The coal/water suspensions that are utilized in this connection are characterized by a very large fraction of fine coal particles, a relatively small maximum grain size of, for example, 2 mm, and a large proportion of water. However, for the requirements of the fluidized bed combustion units, the grain diameters of the suspensions that are suitable for the burners are too small. Especially for fluidized bed combustion units, considerably coarser grain sizes are required in order to be able to optimize the retention time of the coal in the combustion chamber, the combustion, and the flue gas emission. Furthermore, a water proportion that is too great reduces the calorific value of the fuel, and hence the efficiency of the combustion unit.

At the same time, where the coal/water mixture is hydraulically conveyed with pumps, especially heavy material pumps, the material being conveyed is compacted by the pressure. In other words, the gaps between grains are reduced, and the water that is bound to the fine grain-size fraction is pressed along with the latter against the walls of the conduits that are provided for conveying the coal/water mixture. This fine grain-size fraction, along with the water, form a lubricating film along the sliding contact surfaces of the conduits. Without this mechanism, it would not be possible to carry out a conveyance through the required lengths of conduits. Thus, when preliminarily crushed raw coal having little water added thereto is hydraulically conveyed via heavy material pumps, preferably piston pumps, and conduits, considerable difficulties arise. Thus, one must proceed from the assumption that the water requirement of raw coal, in order to form a mixture that can be conveyed by pumps, is a function of the grain composition and the gaps or spaces between the coal granules. At least for the binding, in an appropriate manner, of that water that is necessary for the conveyance, finely pulverized fine grain-size fractions in the granule spectrum are necessary. It furthermore appears that a certain percentage of medium-sized granules are advantageous in order to keep the gaps or spaces in the raw material small right from the beginning.

It is therefore an object of the present invention, proceeding from the aforementioned cited art, to provide a method and apparatus for producing a coal/water mixture where the hydraulic conveyance via the pumps is assured without at the same time permitting the proportion of water in the coal/water mixture to become too great.

BRIEF DESCRIPTION OF THE DRAWING

This object, and other objects and advantages of the present invention, will appear more clearly from the following specification in conjunction with the accompanying drawing, which schematically illustrates one exemplary embodiment of the inventive apparatus for carrying out the method of the present invention.

SUMMARY OF THE INVENTION

The method of the present invention includes the steps of: in a first mixing stage, preliminarily mixing a metered quantity of crushed coal with water, including generating, essentially entirely in this first mixing stage, a fine grain-size coal fraction that is rubbed-off from the coal and is required for hydraulic transport of the coal/water mixture; final mixing, in a second mixing stage, the mixture obtained in the first mixing stage; determining the viscosity of the mixture present in the second mixing stage; and as a function of this viscosity, carrying out at least one of the steps of adding additional water to the mixture in the second mixing stage and altering the mixing process in the first mixing stage to thereby alter the fine grain-size coal fraction that is being generated in this first mixing stage.

Thus, with the inventive method the mixing process in the first mixing stage is carried out in such a way that the finely pulverized proportion that is required for the hydraulic transport, and that is missing from the preliminarily crushed coal, is rubbed off from the crushed coal.

After the mixture is transferred from the first mixing stage into the second mixing stage, the viscosity of the mixture is determined. If the mixture that is present in the second mixing stage has an adequate fine grain-size fraction, the viscosity that is required for the subsequent pump, in other words the hydraulic transportability, can be achieved entirely by the supply of residual water. Where the fine grain-size fraction is not adequate, the mixing process in the first stage must be altered in such a way that an alteration of the production of the fine grain-size fraction takes place in this first stage; in particular, the fine grain-size production is increased. In other words, in the second mixing stage, the determining feature is not the water content of the coal/water mixture that is present in this stage, but rather the hydraulic transportability or viscosity of this mixture. Starting from a grain distribution that is aimed at in the first mixing stage, and that is basically suitable for the hydraulic conveyance, and that is set by the rubbing effect of the first mixing stage, the viscosity of the material that is being conveyed, and that is required for the pumping process, is thus regulated via the independent addition of water in the second mixing stage.

The setting or adjustment of the generation of the fine grain-size fraction in the first mixing stage can be achieved by the retention time of the coal in this mixing stage (alteration of the speed of the mixing mechanisms in this stage, alterations of the efficiency of the mixing mechanisms) and/or by the alteration of the filling level of the first mixing stage. Of course, it is also possible to alter the throughput velocity at a constant speed of the drive mechanism merely by adjusting the mixing mechanisms. If, for example, a dual-shaft mixing arm mixer is used in the first mixing stage, the throughput velocity can be altered by adjusting the mixing arms. Alteration of the filling level can, for example, be achieved by adjusting an overflow protection mechanism. Crushers or grinders cannot be used as the first mixing stage because the fine grain-size fraction produced thereby is too great. Crushing machines cannot be used because the water cannot be added during the crushing process.

In a straightforward manner, the viscosity of the mixture in the second mixing stage can be detected by a continuous measurement of the mixing resistance at the mixing mechanisms that effect the mixing process in the second stage. For example, the viscosity can be derived from the mixing resistance of the mixer shafts, with this resistance being registered as torque.

A particularly economical way of carrying out the inventive method is achieved if the first mixing stage is operated discontinuously, while the second mixing stage is operated continuously. As a result of the discontinuous operation, the retention time can be altered in a simple manner, whereas the second mixing stage is operated with a larger mixing capacity that, relative to the combustion, at the same time serves as an equalizing volume.

The apparatus of the present invention comprises: a first mixer that receives coal from a metering feed mechanism connected to a coal bin, with this first mixer including a first mixing hopper, in which is disposed a first mixing mechanism, which is operated by a first drive mechanism; a first means for supplying water to the first mixer; a second mixer for receiving a coal/water mixture from the first mixer, with the second mixer including a second mixing hopper, which is larger than the first mixing hopper, and in which is disposed a second mixing mechanism, which is operated by a second drive mechanism; a second means for supplying water to the second mixer; means for detecting the torque of the second drive mechanism of the second mixing mechanism of the second mixer; and means for varying at least one of: the first drive mechanism of the first mixing mechanism, the operating position of the first mixing mechanism, the filling level of the first mixing hopper, the first means for supplying water to the first mixer, and the second means for supplying water to the second mixer as a function of the torque of the second drive mechanism.

The second mixing hopper is preferably provided with a filling level indicator, in particular a minimum-maximum indicator. In addition, a weighing mechanism means is advantageously associated with the second mixing hopper.

Further specific features of the present invention will be described in detail subsequently.

DESCRIPTION OF PREFERRED EMBODIMENTS

Referring now to the drawing in detail, coarsely crushed crude or raw coal is introduced into a preliminary mixer 3 via a feed mechanism 2 that is operated by a drive mechanism 1. The preliminary mixer 3 essentially comprises a mixing hopper 3*a* and a mixing mechanism 3*b* that is disposed in the hopper 3*a*. The mixing mechanism 3*b* is operated by a drive mechanism 4, and the filling level of the mixing hopper 3*a* is determined by an overflow protection mechanism 6 that is illustrated only schematically in the drawing, and that is adjustable via a control mechanism 5. It should be noted that although in the drawing the preliminary mixer is illustrated as a single-shaft mixer having a shaft 3*b*′ with mixing arms 3*b*″ secured thereto, other types of mixers could also be used, such as a dual-shaft mixer.

Water can be supplied to the mixing hopper 3*a* via a controllable valve 7. Furthermore, a sulfur-binding additive, such as lime, limestone, dolomite, etc., can be introduced into the preliminary mixer 3 via a feed mechanism 9 that is operated by a drive mechanism 8.

On the outlet side, the preliminary mixer 3 is connected to a final or follow-up mixer 10 that essentially comprises a mixing hopper 10*a*, the capacity of which is greater than the capacity of the mixing hopper 3*a*, and a mixing mechanism 10*b* that is operated by a drive mechanism 11 via a shaft 12.

Associated with the shaft 12 is a torque pickup 13 via which the mixing resistance of the mixture in the mixing hopper 10*a* can be determined.

Associated with the mixing hopper 10*a* is a measuring device 14 for determining a minimum and maximum position of the mixing level in the hopper 10*a*. In addition, the mixing hopper 10*a* is supported via known weighing mechanisms 15 on the non-illustrated frame of the apparatus.

Water can be supplied to the hopper 10*a* via a controllable valve 7′.

A coal/water mixture is continuously withdrawn from the mixing hopper 10*a* via a dense or heavy material pump 16, and is supplied to the fluidized bed combustion unit 17.

The drive mechanisms 1, 8, and 4, as well as the valves 7 and 7′, the torque pickup 13, the device 14 for measuring the filling state, and the weighing mechanisms 15, are connected to a control and regulating device 18 that is furthermore connected to the control or adjustment mechanism 5 of the overflow protection mechanism 6.

During operation of the apparatus, the drive mechanisms 1 and 8 of the feed mechanisms 2 and 9 respectively, as well as the valve 7, are controlled in such a way that predetermined quantities of coarsely crushed coal, additive, and water enter the mixing hopper 3*a*; at the same time, the drive mechanism 4 is actuated.

The parameters of the mixing process, such as the retention time in the mixing hopper 3*a*, the speed of the drive mechanism 4, and the filling level, are set in such a way that the desired rubbing-off of the fine grain-size fraction is effected during the mixing process. After the prescribed retention time, the mixture is transferred from the mixing hopper 3*a* to the mixing hopper 10*a*. The process is based on the premise that the mixing hopper is already filled to such an extent that the level of the mixture in the second mixing hopper is between the minimum and maximum levels. The minimum level is such that the mixing mechanism 10*b* is constantly immersed in the mixture. Due to its large capacity, the hopper 10*a* acts as a homogenizing equalizing hopper for the finished charge that is supplied from the preliminary mixer at any given time.

Since the mixing mechanism 10*b* is immersed in the mixture in the hopper 10*a*, the torque determined by the pickup 13 is a measure of the viscosity of the mixture. If the viscosity corresponds to a predetermined value, the control and regulating device 18 additionally opens only the additive water valve 7′, and allows enough additive water to enter so that the mixture withdrawn from the hopper 10*a* has the viscosity that is required for the pumping and conveying process via the pump 16 and the conduit or conduits that lead to the fluidized bed combustion unit 17.

Where the fine grain-size fraction is not adequate, the addition of an expedient quantity of water to the hopper 10*a* will not achieve the viscosity, i.e. the hydraulic transportability, that is required for the pump and the conduits. In other words, the mixing process in the preliminary mixer 3 must be altered in such a way that the required fine grain-size production will occur in the preliminary mixer. For this purpose, the control and regulating device 18 can alter the retention time for the preliminary mixing in the mixing hopper 3*a*. Since the filling level is also a parameter that affects the fine grain-size production, it is also possible to influence this filling level by raising or lowering the overflow protection mechanism 6. It is furthermore possible to use mixing apparatus where the operating position of the mixing arms 3*b*″ can be changed. In addition, the control and regulating device 18 can control the supply of coal, and as a function thereof the supply of additive and the supply of water via the valve 7.

The weighing mechanism or mechanisms 15 serve to provide a control variable when the hopper 10*a* operates full or empty during start-up or non-operation of the combustion unit, since during these operating states the mixing mechanism is no longer completely immersed in the mixture in the hopper 10*a*. In this connection, it would also be possible, in place of a weighing mechanism, to provide a device that measures the filling state between zero and "maximum". This measured value serves as a corrective value for the relationship between measured torque and added water.

In summary, it can be stated that the important thing for the present invention is that the required fine grain-size production takes place in the preliminary mixer 3, with the operating and structural parameters thereof being appropriately designed. For example, the drive mechanism 4 will operate at a considerably greater speed than does the drive mechanism 11.

The inventive mixing process will now be set forth with the aid of the following table.

TABLE

| Product | Fractions (Percent by weight relative to the mixture present at any given time) | Water content (Percent by weight relative to the mixture present at any given time) |
|---|---|---|
| Raw coal | 0–30 mm with 1–9% by wt. <1 mm preferably 5% by wt. <1 mm | 3–15% by wt. preferably 5–12% by wt. in particular preferably 5% by wt. |
| After the 1st mixer | 0–30 mm with 30% by wt. <1 mm preferably 10% by wt. <1 mm | ≦20% by wt. preferably ≦10% by wt. |
| After the 2nd mixer | 0–30 mm with 30% by wt. <1 mm preferably 10% by wt. <1 mm | ≦30% by wt. preferably 12–20% by wt. |

The present invention is, of course, in no way restricted to the specific disclosure of the specification and drawing, but also encompasses any modifications within the scope of the appended claims.

What we claim is:

1. A method of producing a coal/water mixture for combustion in a fluidized bed combustion unit, including the steps of:

in a first mixing stage, preliminarily mixing a metered quantity of crushed raw coal with water, including generating, essentially entirely in this first mixing stage, a fine grain-size coal fraction that is rubbed-off from said coal and is required for hydraulic transport of said coal/water mixture;

final mixing, in a second mixing stage, the mixture obtained in said first mixing stage;

determining the viscosity of the mixture present in said second mixing stage; and as a function of this viscosity, carrying out at least one of the steps of adding additional water to the mixture in said second mixing stage and altering the mixing process in said first mixing stage to thereby alter the fine grain-size coal fraction that is being generated in this first mixing stage.

2. A method according to claim 1, which includes the step of achieving an adjustment of the fine grain-size fraction generation in said first mixing stage by carrying out at least one of the steps of varying the retention time of coal in this first mixing stage and varying the filling level in the latter.

3. A method according to claim 1, in which said step of determining the viscosity of the mixture in said second mixing stage is carried out by continuously measuring the mixing resistance of mixing mechanism means that effect the mixing process in said second stage.

4. A method according to claim 1, which includes the steps of carrying out said preliminary mixing in a discontinuous manner, and carrying out said final mixing in a continuous manner.

5. An apparatus for producing a coal/water mixture for combustion in a fluidized bed combustion unit, comprising:

a first mixer that receives coal from a metering feed mechanism connected to a coal bin, with said first mixer including a first mixing hopper, in which is disposed a first mixing mechanism, which is operated by a first drive mechanism;

a first means for supplying water to said first mixing hopper;

a second mixer for receiving a coal/water mixture from said first mixer, with said second mixer including a second mixing hopper, which is larger than said first mixing hopper, and in which is disposed a second mixing mechanism, which is operated by a second drive mechanism;

a second means for supplying water to said second mixing hopper;

means for detecting the torque of said second drive mechanism of said second mixing mechanism of said second mixer; and means for varying, as a function of said torque of said second drive mechanism, at least one of: said first drive mechanism of said first mixing mechanism, the operating position of said first mixing mechanism, the filling level of said first mixing hopper, said first means for supplying water to said first mixing hopper, and said second means for supplying water to said second mixing hopper.

6. An apparatus according to claim 5, in which said second mixing hopper is provided with a filling state indicator.

7. An apparatus according to claim 6, in which said indicator is a "MIN"/"MAX" indicator.

8. An apparatus according to claim 5, in which a weighing mechanism means is associated with said second mixing hopper.

* * * * *